US007303024B2

(12) United States Patent
Mikulec

(10) Patent No.: US 7,303,024 B2
(45) Date of Patent: Dec. 4, 2007

(54) ACTUATOR FOR FIRE EXTINGUISHER

(76) Inventor: Conrad S. Mikulec, P.O. Box 477, Buffalo, NY (US) 14201

( * ) Notice: Subject to any disclaimer, the term of this patent is extended or adjusted under 35 U.S.C. 154(b) by 5 days.

(21) Appl. No.: 10/707,452

(22) Filed: Dec. 15, 2003

(65) Prior Publication Data

US 2005/0126797 A1 Jun. 16, 2005

(51) Int. Cl.
*A62C 3/00* (2006.01)

(52) U.S. Cl. ..... 169/65; 169/59; 169/60

(58) Field of Classification Search ..... 169/56, 169/57, 58, 59, 60, 65, 42
See application file for complete search history.

(56) References Cited

U.S. PATENT DOCUMENTS 4,813,487 A * 3/1989 Mikulec et al. ..... 169/65
4,979,572 A * 12/1990 Mikulec ..... 169/65
5,063,998 A * 11/1991 Quinn ..... 169/65
5,297,636 A * 3/1994 North ..... 169/65

* cited by examiner

*Primary Examiner*—Steven J. Ganey
(74) *Attorney, Agent, or Firm*—Richard D. Fuerle

(57) ABSTRACT

An actuator for releasing a pressurized fire extinguishing composition from the cylinder of a fire extinguisher has an elongated body made of a single piece. The body has a longitudinal chamber that extends through it for holding a ram that moves along the chamber and a spring for propelling the ram, a first transverse aperture for holding a trigger that releases the spring and a second transverse aperture for holding a member that moves due to movement of the ram, where both apertures join the chamber. Movement of the member releases the composition from cylinder. A microswitch or a cable, activated by the ram, may be attached to either or both ends of the chamber.

21 Claims, 7 Drawing Sheets

ACTUATOR FOR FIRE EXTINGUISHER

BACKGROUND OF INVENTION

This invention relates to an actuator for releasing a pressurized fire extinguishing composition from a fire extinguisher. In particular, it relates to an actuator that has a body made from a single piece.

U.S. Pat. No. 4,979,572 shows a fire extinguisher having an actuator that is activated when a fusible link breaks, releasing a trigger. A version of that fire extinguisher has been commercialized by the inventor, who is also the inventor of the instant application. FIGS. 2 and 3 of the patent show the parts of the actuator (valve opening mechanism 40). While the patent does not describe how the actuator was made, the drawings show that header 26 is a tube that has a second tube (not numbered) inside and that various other parts are attached to those tubes. Several of those parts were attached by welding them to the tubes. Misalignments sometimes occurred, resulting in defective actuators that had to be discarded.

SUMMARY OF INVENTION

I have discovered that the body of an actuator for a fire extinguisher can be made from a single piece, such as from an extrusion. Thus, instead of beginning with a tube and welding parts to the tube, an extrusion is drilled and machined. Since drilling and machining can be performed more accurately than welding, bodies made this way are less likely to be defective.

I have also found that a fusible link can be directly attached to the actuator. This simplifies the construction of the actuator, making it more reliable and less costly.

A microswitch or cable connection, which turns off the gas or electricity going to a stove and/or turns on an alarm, can be attached to either end of the actuator of this invention.

DETAILED DESCRIPTION

Figure 1:
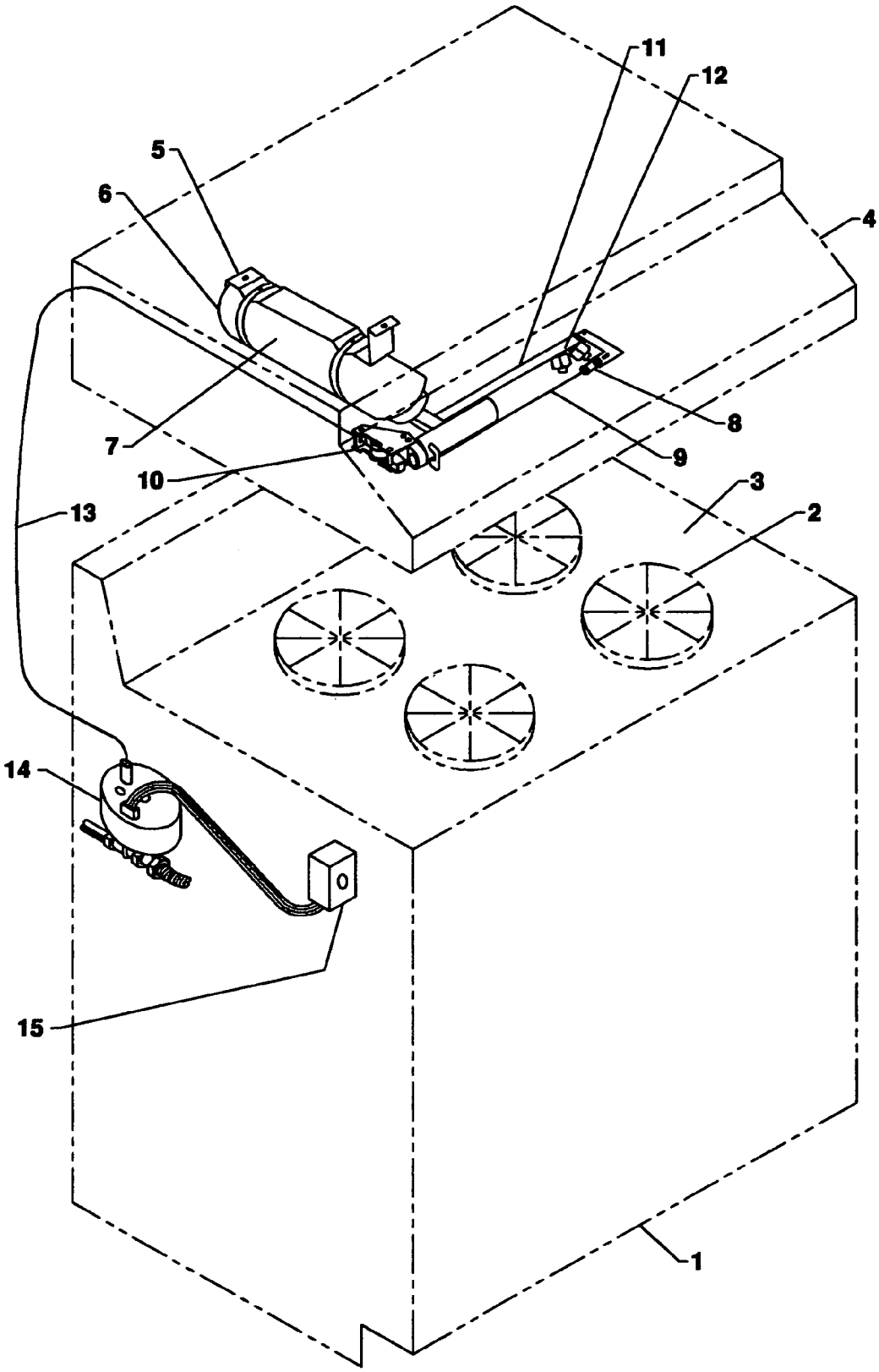
FIG. 1 is an isometric view of the top of a four-burner stove having a hood with a fire extinguisher that uses an actuator according to this invention installed therein.

In FIG. 1, a presently preferred embodiment of a fire extinguisher that employs the actuator of this invention is shown installed in the hood of a stove. Gas stove 1, has four gas burners 2 on its top surface 3. Above top surface 3 (typically about 26 to about 28 inches higher) is a hood 4 having a fan (not shown) inside for drawing fumes from the burners into an exhaust (not shown). Fire extinguisher 5 is mounted in the side of hood 4. Extinguisher 5 has a cylinder

Figure 6:
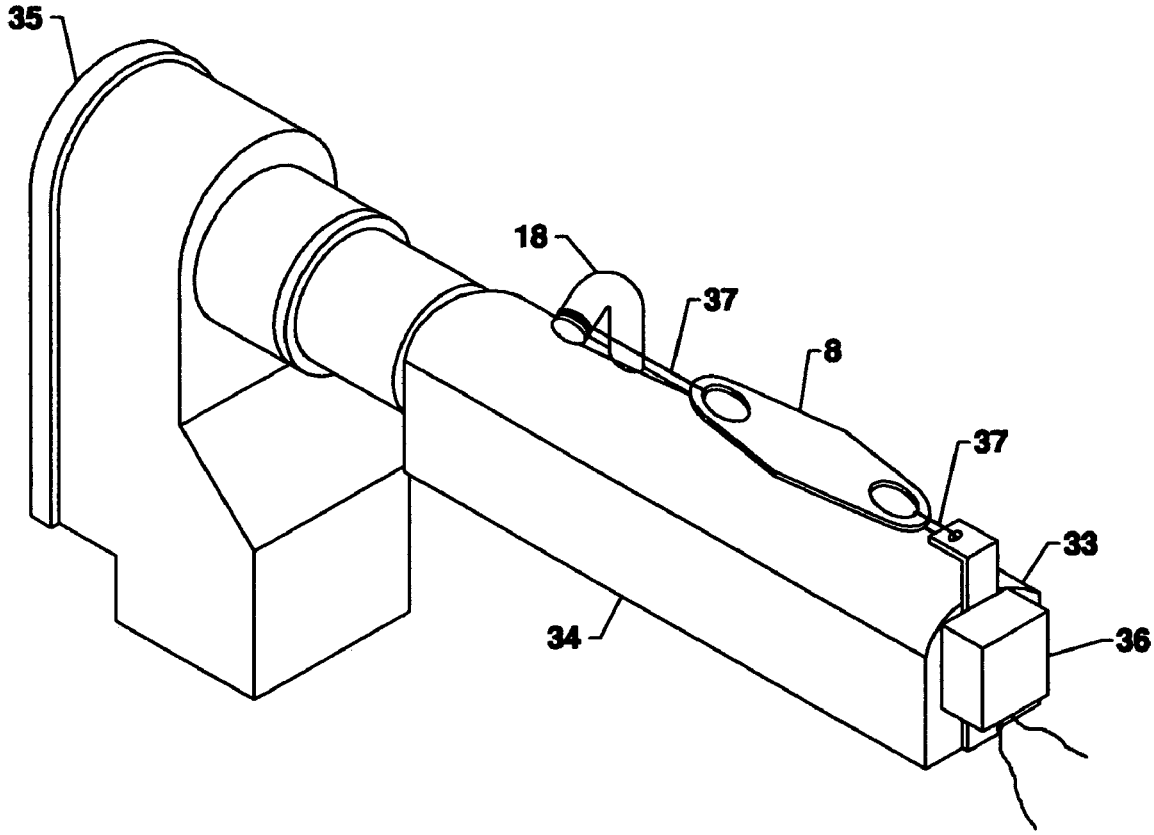
FIG. 6 is an isometric view of an actuator having a fusible link attached to one end.

6 containing a fire extinguishing composition 7. Fusible link 8 is attached to a wire 9. When a fire causes fusible link 8 to break, wire 9 is released, activating actuator 10. Actuator 10 causes cylinder 6 to open, releasing composition 7, which is carried by conduit 11 to nozzles 12, which spray it onto top surface 3 of stove 1. Actuator 10 also has a sheathed cable 13 attached to one end. Cable 13 is connected to gas shut-off box 14, which shuts off the supply of gas to stove 1 and also sets off alarm 15. (For an electrical stove, an electrical shut-off box would be used.) Instead of cable 13, a microswitch may be used to send an electrical signal to shut-off box 14 (FIG. 6).

Figure 2:
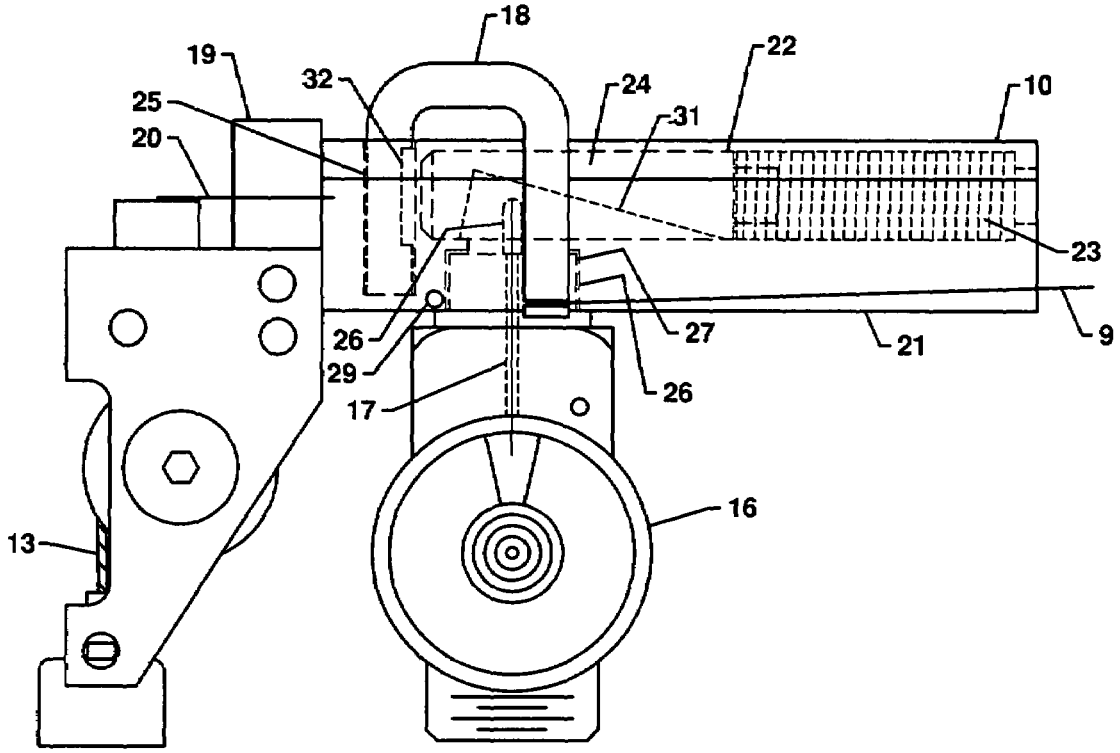
FIG. 2 is a side view, partially in section, of an actuator according to this invention.
Figure 3:
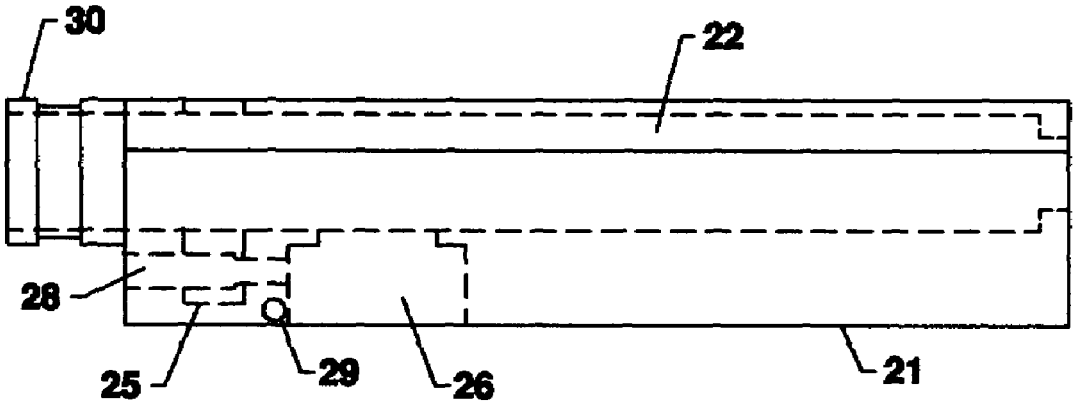
FIG. 3 is a side view of the body of the actuator shown in FIG. 2.

Referring to FIG. 2 as well as FIG. 1, attached to one end of cylinder 6 is a release valve 16 which is opened when button 17 is depressed. Over release valve 16 is screwed actuator 10 and into the side of release valve 16 is screwed conduit 11. One side of fusible link 8 is attached to the end of conduit 11 and the other side is attached under tension by wire 9 to composition release trigger 18. When a fire heats fusible link 8 to a predetermined temperature it breaks, relieving the tension on trigger 18, which results in button 17 being depressed, releasing the fire extinguishing composition 7 in cylinder 6. To one end of actuator 10 is attached cable box 19, which contains a spring and a ratchet to maintain tension on cable 13 until the tension is released by cable trigger 20, which causes shut-off box 14 to turn off the gas going to stove 1.

Referring to FIGS. 2, 3, 4, and 5, actuator 10 has a body 21 that is a single piece. That is, body 21 is not assembled from two or more pieces by, for example, welding or gluing them together. Rather, it is made from a single extruded, molded, or cast piece, and portions of that single piece are removed, if necessary, to form the body of the actuator. Preferably, the body is made from an extrusion, preferably of a metal such as aluminum or steel. The extrusion is then drilled, machined, and threaded to form the required functional shape of body 21. Body 21 may also be cast or molded as a single piece, thereby eliminating some or all of the drilling, machining, and threading. A molded or cast piece may be made from various metals, glasses, ceramics, or plastics.

To make body 21 from an extruded piece, body 21 is extruded with a longitudinal channel therethrough (off center) and that channel is enlarged for most of its length by drilling, which forms longitudinal chamber 22 (dotted lines), into which is fitted spring 23 and ram 24. A first transverse aperture 25 is drilled into one side of body 21 for insertion of trigger 18. A second transverse aperture 26 is drilled into body 21 and is female threaded so that actuator 10 can be screwed on to the top of release valve 16. Second traverse aperture 26 is drilled twice so that it has a smaller diameter where it joins chamber 22 in order to provide support for fitting 27 and button 17. A small hole 28 is drilled to accommodate a set screw (not shown) for securing release valve 16 to actuator 10 and another small hole 29 (FIG. 3) is drilled for insertion of a stop (not shown) that prevents trigger 18 from being released during shipment. The end of body 21 to which cable box 19 is attached is machined to form coupling 30, which has a circumferential grove. Cable box 19 is secured to coupling 30 by means of a screw that fits into that grove.

Figure 4:
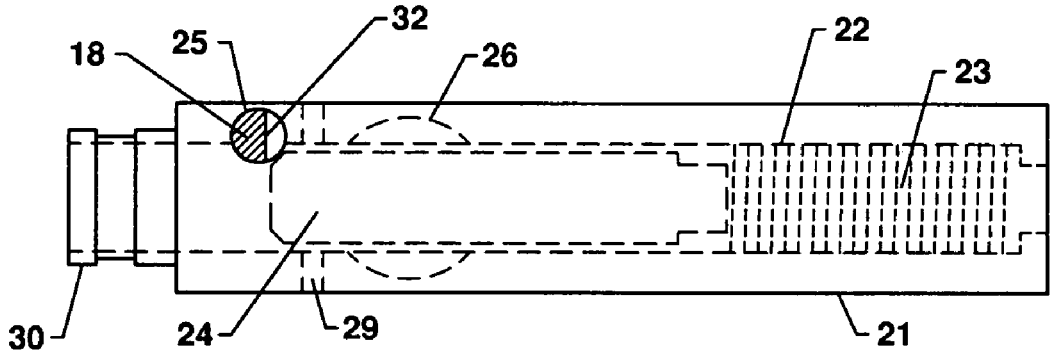
FIG. 4 is a plan view of the body of the actuator shown in FIG. 2.
Figure 5:
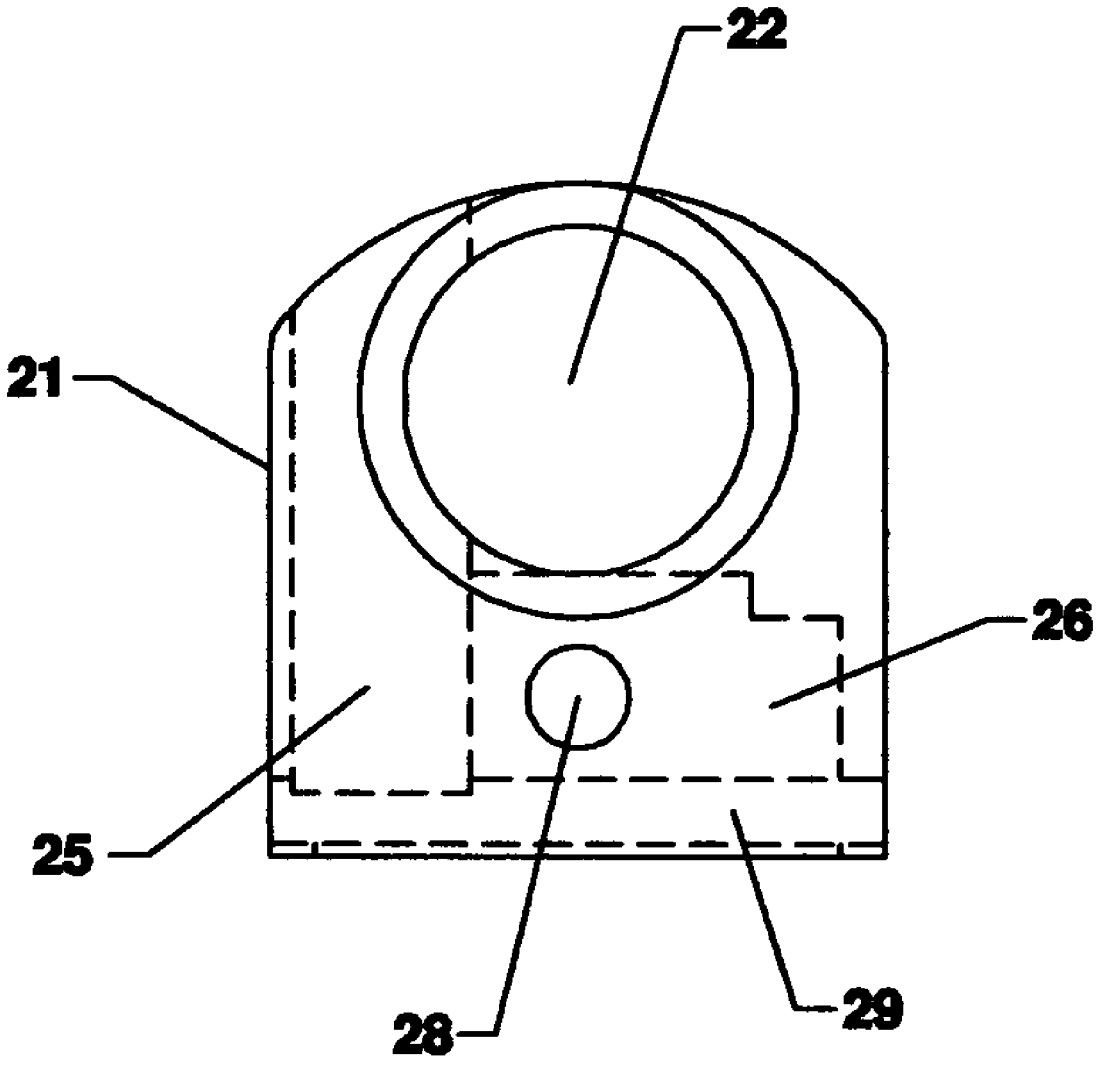
FIG. 5 is an end view of the body of the actuator shown in FIG. 2.

Referring particularly to FIGS. 2 and 4, inside body 21, spring 23 is compressed between one end of body 21 and ram 24. Ram 24 has a sloped indented portion 31 into which extends rod 27. The end of U-shaped trigger 18 that is in first transverse aperture 25 has a flat side 32. Ram 24, under pressure from spring 23, presses against flat side 32, but wire 9 prevents trigger 18 from turning, which would allow ram 24 to move pass flat side 32. When fusible link 8 breaks, trigger 18 rotates in aperture 25 due to pressure from ram 24 against flat side 32 and ram 24 is propelled by spring 23 past flat side 32 and along chamber 22. Sloped indented portion 31 of ram 24 forces rod 27 to move along second traverse aperture 26, depressing button 17, which opens release valve 16. Ram 24 also strikes cable trigger 20, releasing tension on cable 13, which activates shut-off box 14, shutting off stove 1 and setting off alarm 15.

FIG. 6 shows an activator 34 that is similar to the activator shown in FIGS. 2 to 5, but has microswitch at both ends. Microswitch 35 sends an electrical signal to shut-off box 14 and microswitch 36 may set off an alarm or may notify a person that the extinguisher has gone off. (One microswitch may be activated when it is depressed by the ram and the other microswitch may be activated when it is no longer depressed by the ram.) Also, fusible link 8 is attached by wires 37 between trigger 18 and one end 33 of actuator 34. If a fire extinguisher is used that has two cylinders, fusible link 8 can be attached by wires between the triggers of two actuators, so that when fusible link 8 breaks, composition is released from both extinguishers.

Fusible link 8 is preferably a (commercially available) sealed glass container that is partially filled with a liquid (FIG. 6). The glass container prevents two metal pieces, to which wires are attached, from separating until fire heats and breaks the glass container. Metals that weaken and fail at a predetermined temperature can also be used as fusible links.

Figure 7:
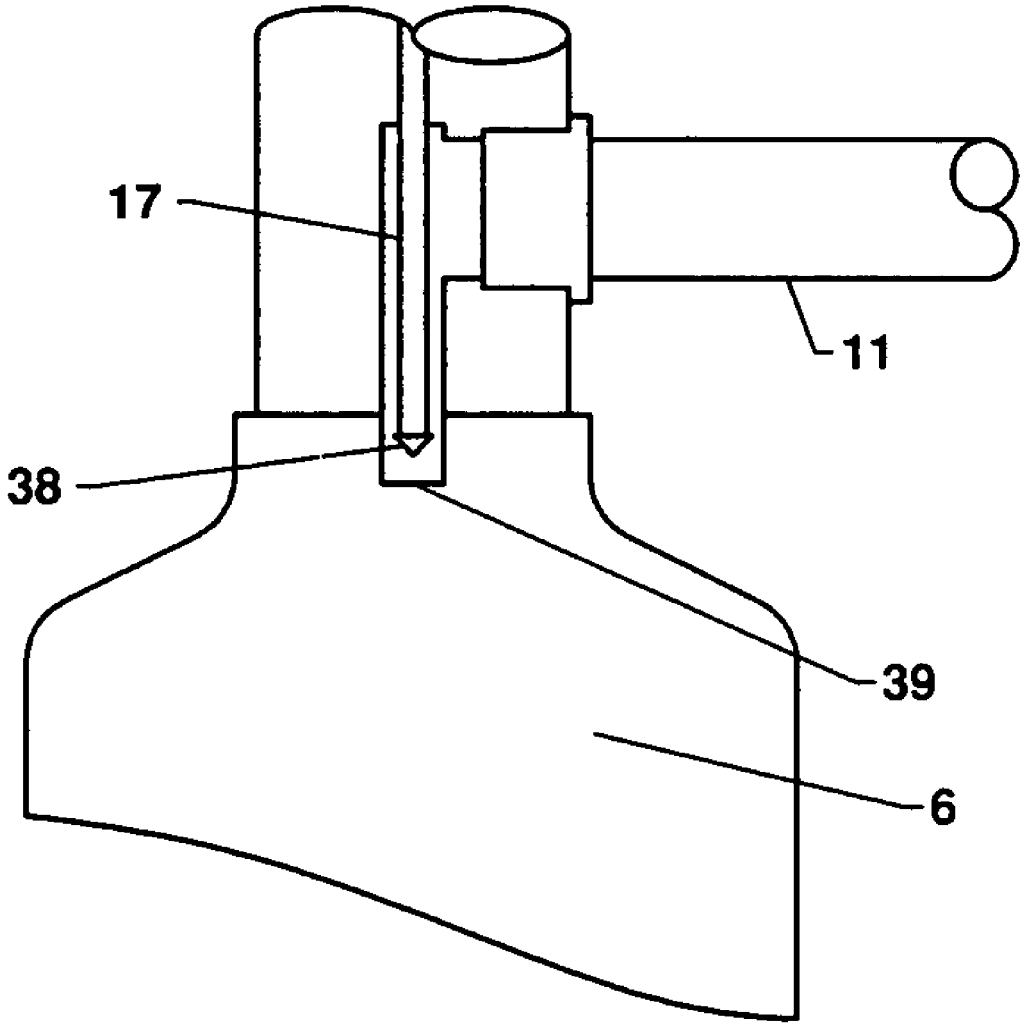
FIG. 7 is a side view in section illustrating a plunger for piercing a seal to release a fire extinguishing composition from a cylinder.

The fire extinguishing composition may be released from the cylinder by various means. For example, a rod may depress a button, as shown in the drawings, or the cylinder may be sealed and a sharp plunger 38 (FIG. 7) may be driven by the ram into a seal 39 (see, for example, FIG. 3 of U.S. Pat. No. 4,979,572, herein incorporated by reference).

The actuator of this invention can be used in almost any type of fire extinguisher, including hand-held fire extinguishers, stove fire extinguishers installed in a hood, and extinguishers for engines, such as boat engines.

The invention claimed is:

1. An actuator for releasing a fire extinguishing composition that is stored under pressure in the cylinder of a fire extinguisher, comprising an elongated body having two ends, where said body is made of a single piece and that has (A) a longitudinal chamber that extends through said body, for holding a ram that moves therein and a spring for propelling said ram, where one end of said single piece body extends inward, whereby said longitudinal chamber has a smaller diameter at said one end that stops said spring and the other of said ends has means for attaching a cable box;

(B) a first transverse aperture that joins said chamber, for holding a trigger that releases said spring; and (C) a second transverse aperture that joins said chamber, for holding a member that moves in response to movement of said ram, where movement of said member activates the release of said composition from said cylinder.

2. An actuator according to claim 1 wherein a microswitch that is activated by said ram is attached at one end of said chamber.

3. An actuator according to claim 1 wherein a cable that slides in a sheath and is activated by said ram is attached at one end of said chamber.

4. An actuator according to claim 1 wherein a microswitch or a cable that is activated by said ram is attached at each end of said chamber.

5. An actuator according to claim 4 wherein a fusible link is attached between said trigger and one end of said body.

6. An actuator according to claim 1 wherein said member is a plunger that pierces a seal on said cylinder.

7. An actuator according to claim 1 wherein said member is a rod that depresses a button on said cylinder.

8. An actuator according to claim 1 wherein said body is provided with an additional aperture for the insertion of a removable stop that prevents said trigger from being released during shipment.

9. An actuator according to claim 1 including a ram and a compressed spring within said longitudinal chamber, a trigger within said first aperture, and a member within said second aperture.

10. An actuator according to claim 1 wherein said body is an extrusion.

11. An actuator according to claim 10 wherein said extrusion is metal.

12. An actuator according to claim 1 wherein said body is made by extruding metal to form a single extruded piece, then removing portions of said single extruded piece.

13. An actuator according to claim 1 wherein said single piece is cast or molded.

14. A fire extinguisher activated by an actuator according to claim 1.

15. A stove hood having a fire extinguisher according to claim 14 mounted therein.

16. A method of making an actuator according to claim 1 comprising extruding metal to form said single piece.

17. An actuator for releasing a fire extinguishing composition that is stored under pressure in the cylinder of a fire extinguisher, comprising an elongated body made of a single piece, said body having (A) a longitudinal chamber that extends through said body, for holding a ram that moves therein and a spring for propelling said ram;

(B) a first transverse aperture that joins said chamber, for holding a trigger that releases said spring; and (C) a second transverse aperture that joins said chamber, for holding a member that moves in response to movement of said ram, where movement of said member activates the release of said composition from said cylinder and a microswitch or a cable that is activated by said ram is attached at each end of said chamber.

18. A fire extinguisher activated by an actuator according to claim 17.

19. A hood for a stove having a fire extinguisher according to claim 18 mounted therein.

20. An actuator for releasing a fire extinguishing composition that is stored under pressure in the cylinder of a fire extinguisher, comprising an elongated body made of a single piece, said body having (A) a longitudinal chamber that extends through said body, for holding a ram that moves therein and a spring for propelling said ram;

(B) a first transverse aperture that joins said chamber, for holding a trigger that releases said spring; and (C) a second transverse aperture that joins said chamber, for holding a rod that depresses a button on said cylinder in response to movement of said ram, where depressing said button activates the release of said composition from said cylinder.

21. A hood for a stove having a fire extinguisher according to claim 20 mounted therein.

* * * * *